US012111095B2

(12) United States Patent
Li et al.

(10) Patent No.: US 12,111,095 B2
(45) Date of Patent: Oct. 8, 2024

(54) REFRIGERATOR

(71) Applicants: QINGDAO HAIER REFRIGERATOR CO., LTD., Shandong (CN); HAIER SMART HOME CO., LTD., Shandong (CN)

(72) Inventors: Mengcheng Li, Qingdao (CN); Xiaobing Zhu, Qingdao (CN); Jianru Liu, Qingdao (CN); Shanshan Liu, Qingdao (CN); Wei Li, Qingdao (CN); Yang Liu, Qingdao (CN); Yunxi Liu, Qingdao (CN)

(73) Assignees: Qingdao Haier Refrigerator Co., Ltd., Qingdao (CN); Haier Smart Home Co., Ltd., Qingdao (CN)

( * ) Notice: Subject to any disclaimer, the term of this patent is extended or adjusted under 35 U.S.C. 154(b) by 269 days.

(21) Appl. No.: 17/642,316

(22) PCT Filed: Sep. 9, 2020

(86) PCT No.: PCT/CN2020/114256
§ 371 (c)(1),
(2) Date: Mar. 11, 2022

(87) PCT Pub. No.: WO2021/047549
PCT Pub. Date: Mar. 18, 2021

(65) Prior Publication Data

US 2022/0341655 A1 Oct. 27, 2022

(30) Foreign Application Priority Data

Sep. 12, 2019 (CN) ..... 201910865973.4

(51) Int. Cl.
*F25D 23/00* (2006.01)
*F25D 17/06* (2006.01)
(Continued)

(52) U.S. Cl.
CPC ..... *F25D 23/006* (2013.01); *F25D 17/065* (2013.01); *F25D 17/067* (2013.01); *F25D 21/08* (2013.01); *F25D 23/066* (2013.01)

(58) Field of Classification Search
CPC .... F25D 23/006; F25D 17/065; F25D 17/067; F25D 21/08; F25D 23/066; F25D 23/028; F25D 11/02; F25B 43/006
See application file for complete search history.

(56) References Cited

U.S. PATENT DOCUMENTS 3,104,533 A 9/1963 O'Connell
3,433,031 A * 3/1969 Koch ..... F25D 19/02 62/448
3,455,119 A * 7/1969 Bright ..... F25D 17/065 62/405

FOREIGN PATENT DOCUMENTS

CN 102425913 A 4/2012
CN 105066525 A 11/2015
(Continued)

OTHER PUBLICATIONS

1st Examination Report for Australia Patent Application No. 2020346227 dated Feb. 22, 2023 (4 pages).
(Continued)

*Primary Examiner* — Lionel Nouketcha
(74) *Attorney, Agent, or Firm* — Alston & Bird LLP

(57) ABSTRACT

A refrigerator includes a cabinet, in which a cooling chamber and at least one storage space are defined, the cooling chamber being arranged at the bottom of the cabinet and directly below the storage space; a door body, which is arranged on a front surface of the cabinet so as to operably open and close the storage space; an evaporator, which is wholly horizontally placed in the cooling chamber in the shape of a flat cube, and is configured to provide cooling capacity to the storage space; and a liquid storage bag, which
(Continued)

is arranged in the cooling chamber and connected to the evaporator. An included angle between a center line of the liquid storage bag and a horizontal line is 1° to 89°. A foam layer and a housing of the refrigerator may block the sound transmission of flow of a liquid refrigerant, to achieve a good sound insulation effect.

9 Claims, 10 Drawing Sheets

(51) Int. Cl.
*F25D 21/08* (2006.01)
*F25D 23/06* (2006.01)

(56) References Cited

FOREIGN PATENT DOCUMENTS

| | | | | |
|---|---|---|---|---|
| CN | 205818933 | U | | 12/2016 |
| CN | 208688079 | U | | 4/2019 |
| CN | 208817767 | U | | 5/2019 |
| CN | 208817803 | U | | 5/2019 |
| CN | 208817811 | U | * | 5/2019 |
| CN | 208817837 | U | | 5/2019 |
| CN | 208920651 | U | | 5/2019 |
| CN | 110567214 | A | | 12/2019 |
| CN | 210832700 | U | | 6/2020 |
| JP | 2019-143890 | A | | 8/2019 |
| WO | WO 2011007971 | A2 | | 1/2011 |

OTHER PUBLICATIONS

European Search Report for EP Patent Application No. 20862140.9 dated Aug. 5, 2022 (4 pages).
1st Office Action for EP Patent Application No. 20862140.9 dated Aug. 18, 2022 (4 pages).
International Search Report for PCT/CN2020/114256 (ISA/CN) mailed Dec. 9, 2020 with English translation (6 pages).
Written Opinion for PCT/CN2020/114256 (ISA/CN) mailed Dec. 9, 2020 (4 pages).
1st Office Action for China Patent Application No. 201910865973.4 dated Jan. 25, 2024 (14 pages).
3rd Office Action for China Patent Application No. 201910865973.4 dated Jul. 4, 2024 (16 pages).

* cited by examiner

REFRIGERATOR

CROSS-REFERENCE TO RELATED APPLICATIONS

The present application is a national phase entry of International Application No. PCT/CN2020/114256, filed Sep. 9, 2020, which claims priority to Chinese Patent Application No. 201910865973.4, filed Sep. 12, 2019, which are each incorporated herein by reference in their entirety.

FIELD OF THE INVENTION

The present invention relates to the technical field of household appliances, and in particular, relates to a refrigerator.

BACKGROUND OF THE INVENTION

With the increasing development of society and the continuously improved living standard of people, the pace of life of people is faster and faster, and a lot of foods may be purchased and stored at a time. In order to guarantee the storage effect of the foods, refrigerators become one of indispensable household appliances in daily life of people.

A refrigerator generally utilizes an evaporator to provide cooling capacity for a storage space, and air with an increased temperature in the storage space returns to the evaporator, so that air circulation is formed. In addition, the role of an accumulator in a refrigerating system is also important, but the existing accumulator is generally placed on an air return pipe and is arranged in a foam layer of a refrigerator cabinet. When the refrigerating system works, the flowing sound of a liquid refrigerant is large and difficult to eliminate, noise is easily transmitted to the external environment through a housing of the cabinet, and user experience is influenced.

BRIEF DESCRIPTION OF THE INVENTION

An object of the present invention is to reduce noise generated by the flow of a liquid refrigerant and make the internal layout of a cooling chamber compact.

A further object of the present invention is to avoid frosting of a refrigerating fan caused by return air and ensure the working reliability of the refrigerating fan.

Specifically, the present invention provides a refrigerator. The refrigerator includes a cabinet, in which a cooling chamber and at least one storage space are defined, the cooling chamber being arranged at the bottom of the cabinet and directly below the storage space; a door body, which is arranged on a front surface of the cabinet so as to operably open and close the storage space; an evaporator, which is wholly horizontally placed in the cooling chamber in the shape of a flat box, and is configured to provide cooling capacity to the storage space; and an accumulator, which is arranged in the cooling chamber and connected to the evaporator. An included angle between a center line of the accumulator and a horizontal line is 1° to 89°.

Optionally, there are a plurality of storage spaces including a refrigeration space and at least one freezing space. And the cabinet includes a freezing liner, the cooling chamber and the at least one freezing space located above the cooling chamber being defined in the freezing liner; and a refrigeration liner arranged above the freezing liner, the refrigeration space being defined in the refrigeration liner.

Optionally, the refrigerator further includes an air supply duct which is arranged on inner sides of rear walls of the refrigeration liner and the freezing liner, an air supply inlet in communication with the cooling chamber is formed in a bottom end of the air supply duct, and air supply outlets are formed corresponding to the refrigeration space and the freezing space, respectively, so as to transmit the cooling capacity provided by the evaporator to the storage spaces.

Optionally, the refrigerator further includes a refrigerating fan which is arranged behind the evaporator, and the air blowing direction of the refrigerating fan directly faces the air supply inlet, so that the cooling capacity generated by the evaporator can enter the air supply duct.

Optionally, the accumulator is arranged in a space enclosed by the refrigerating fan, the evaporator and a right side of the freezing liner; or the accumulator is arranged in a space enclosed by the refrigerating fan, the evaporator and a left side of the freezing liner; or the accumulator is arranged between the evaporator and the right side of the freezing liner; or the accumulator is arranged between the evaporator and the left side of the freezing liner; or the accumulator is arranged between the evaporator and the refrigerating fan.

Optionally, the evaporator includes an evaporator body, an upper cover plate and a lower cover plate. The evaporator body includes a plurality of fins arranged in parallel and a coil penetrating through the fins, the upper cover plate is arranged at the top of the evaporator body, and the lower cover plate is arranged at the bottom of the evaporator body.

Optionally, notches are formed in corresponding positions of each fin, and passages laterally extending along the evaporator are formed by the notches in the corresponding positions. And the refrigerator further includes a heating wire embedded in the passages to defrost the evaporator.

Optionally, first fixing holes are formed in four corners of the upper cover plate, and second fixing holes are correspondingly formed in four corners of the top of the evaporator body in position. Third fixing holes are formed in four corners of the lower cover plate, and fourth fixing holes are correspondingly formed in four corners of the bottom of the evaporator body in position.

Optionally, the evaporator further includes fixing members configured to pass through the aligned first and second fixing holes to fix the upper cover plate and the evaporator body, and pass through the aligned third and fourth fixing holes to fix the lower cover plate and the evaporator body.

Optionally, the first fixing holes and the third fixing holes are kidney-shaped holes, and the second fixing holes and the fourth fixing holes are circular holes.

The refrigerator provided by the present invention includes the cabinet, in which the cooling chamber and the at least one storage space are defined, the cooling chamber being arranged at the bottom of the cabinet and directly below the storage space; the door body, which is arranged on the front surface of the cabinet so as to operably open and close the storage space; the evaporator, which is wholly horizontally placed in the cooling chamber in the shape of a flat box, and is configured to provide cooling capacity to the storage space; and the accumulator, which is arranged in the cooling chamber and connected to the evaporator. The included angle between the center line of the accumulator and the horizontal line is 1° to 89°. The accumulator is arranged in the cooling chamber, and the foam layer and the housing of the refrigerator may block the sound transmission of the flow of a liquid refrigerant, and in particular, the foam layer has a good sound insulation effect. The accumulator is connected to the evaporator and the included angle between the center line of the accumulator and the horizontal line is 1° to 89°, which can make the internal structure of the cooling chamber compact and prevent the occupation of too much space.

Further, in the refrigerator provided by the present invention, the evaporator includes the evaporator body, the upper cover plate and the lower cover plate. The evaporator body includes the plurality of fins arranged in parallel and the coil penetrating through the fins, the upper cover plate is arranged at the top of the evaporator body, and the lower cover plate is arranged at the bottom of the evaporator body. The first fixing holes are formed in four corners of the upper cover plate, and the second fixing holes are correspondingly formed in four corners of the top of the evaporator body in position. The third fixing holes are formed in four corners of the lower cover plate, and the fourth fixing holes are correspondingly formed in four corners of the bottom of the evaporator body in position. The evaporator further includes the fixing members configured to pass through the aligned first and second fixing holes to fix the upper cover plate and the evaporator body, and pass through the aligned third and fourth fixing holes to fix the lower cover plate and the evaporator body. The first fixing holes and the third fixing holes are kidney-shaped holes, and the second fixing holes and the fourth fixing holes are circular holes, so that it is guaranteed that there is no gap between the upper cover plate and the evaporator body and between the lower cover plate and the evaporator body after they are fixed, the situation that the refrigerating fan is frosted up due to the fact that return air of the freezing space directly blows to the refrigerating fan without heat exchange through the evaporator is avoided, the working reliability of the refrigerating fan is effectively guaranteed, and thus the overall refrigerating capacity of the refrigerator is improved. In addition, the upper cover plate and the lower cover plate are arranged at the top and the bottom of the evaporator body respectively, so that the overall structure of the evaporator is simplified, and the production cost is effectively reduced.

The above, as well as other objectives, advantages, and characteristics of the present invention, will be better understood by those skilled in the art according to the following detailed description of specific embodiments of the present invention taken in conjunction with the accompanying drawings.

BRIEF DESCRIPTION OF THE DRAWINGS

In the following part, some specific embodiments of the present invention will be described in detail in an exemplary rather than limited manner with reference to the accompanying drawings. The same reference numerals in the accompanying drawings indicate the same or similar components or parts. Those skilled in the art should understand that these accompanying drawings are not necessarily drawn to scale. In figures.

DETAILED DESCRIPTION

Figure 1:
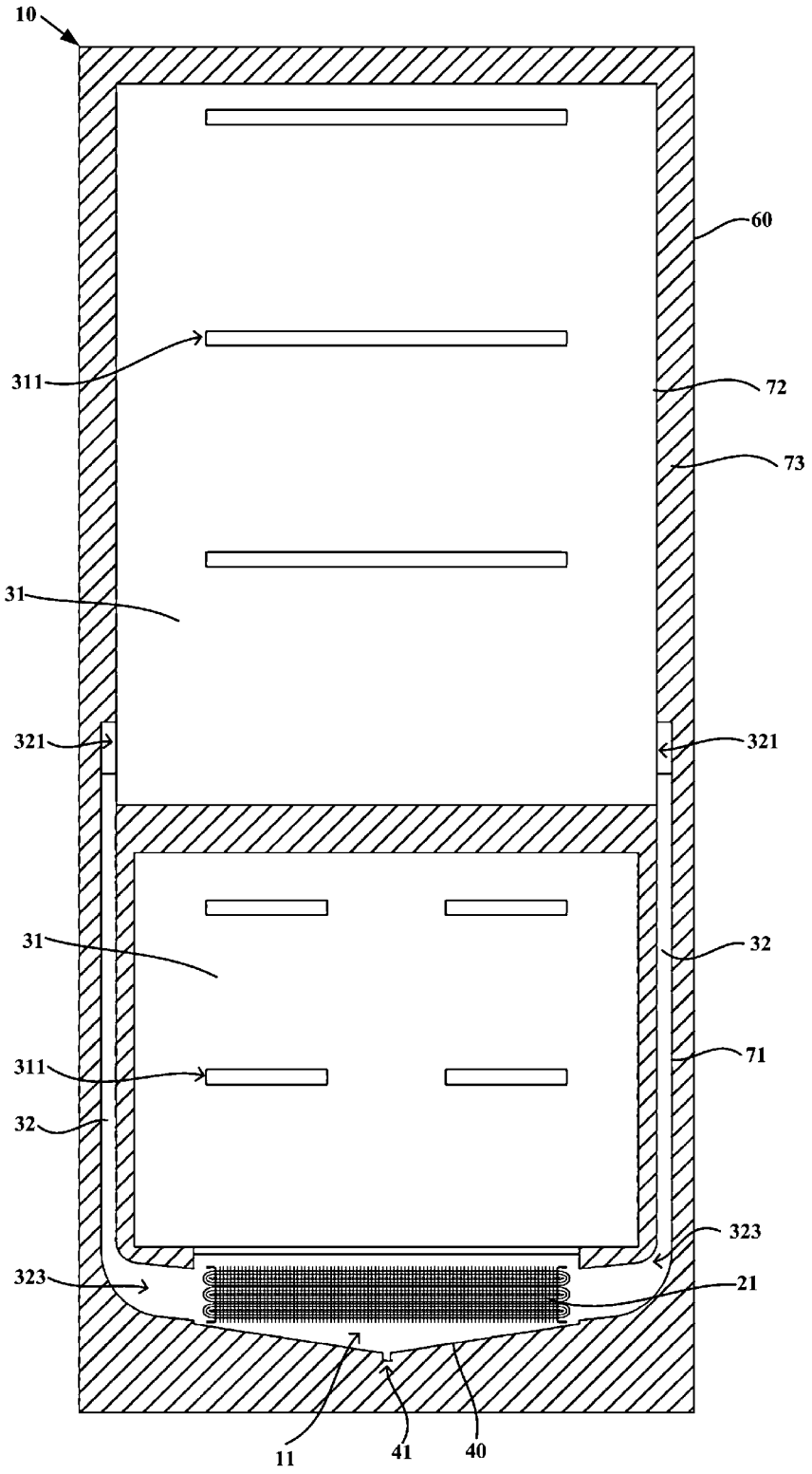
FIG. 1 is a schematic diagram of a front structure of a refrigerator according to an embodiment of the present invention.
Figure 2:
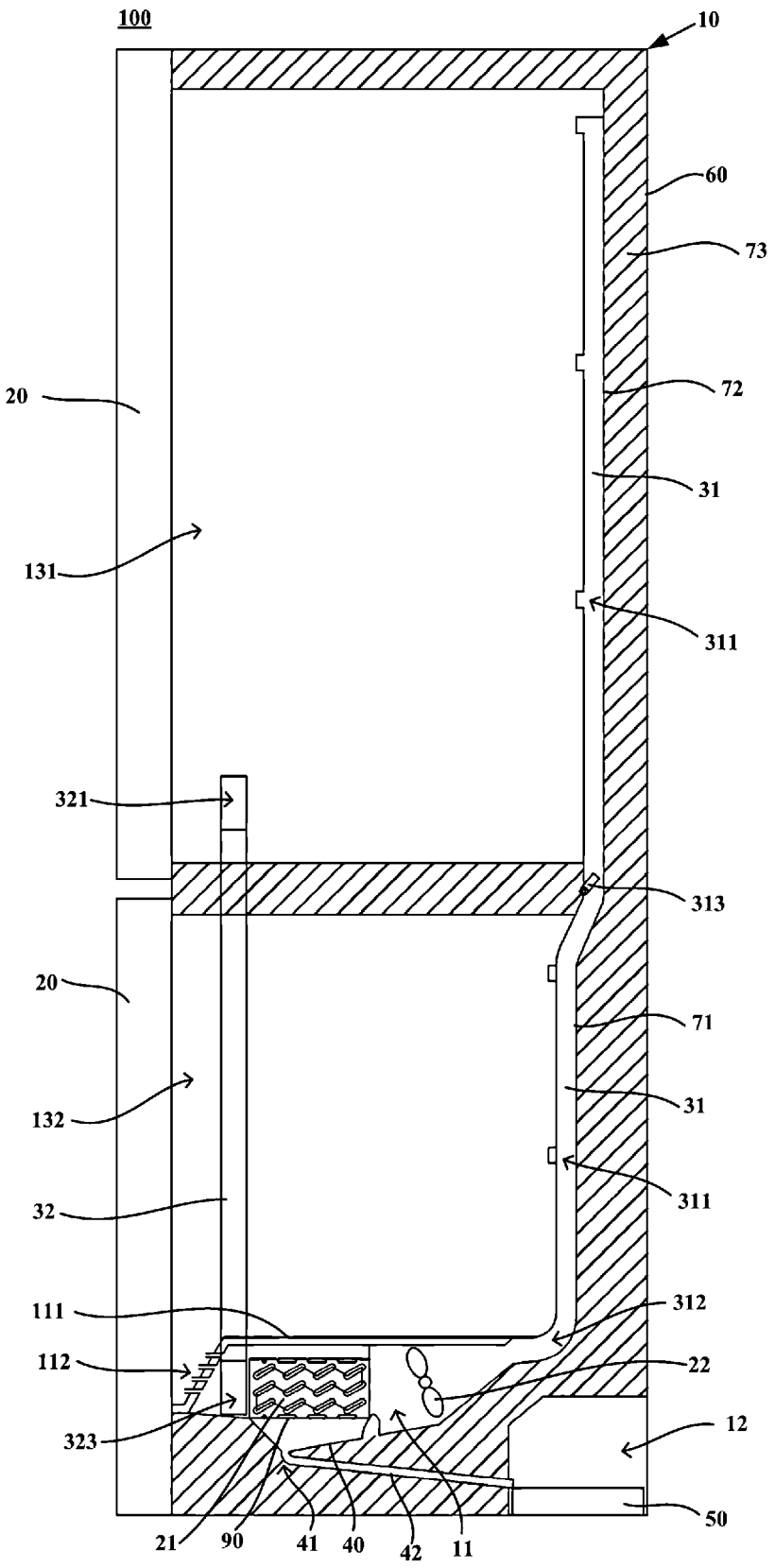
FIG. 2 is a schematic diagram of a side structure of a refrigerator according to an embodiment of the present invention.
Figure 3:
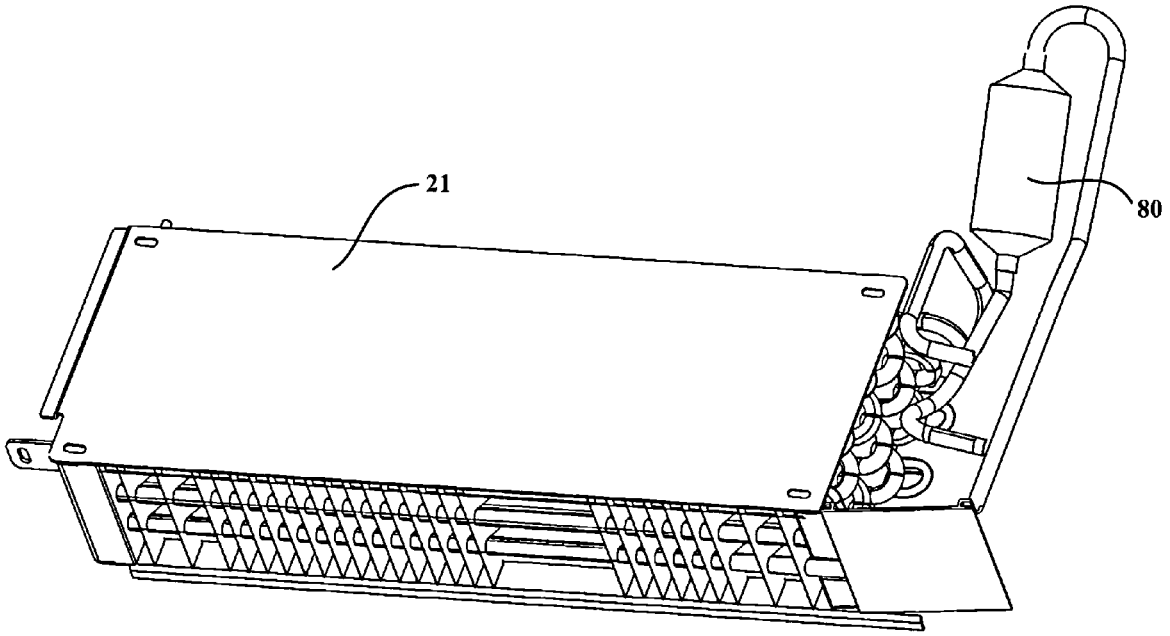
FIG. 3 is a schematic diagram of a connection structure of an evaporator and an accumulator of a refrigerator according to an embodiment of the present invention.
Figure 4:
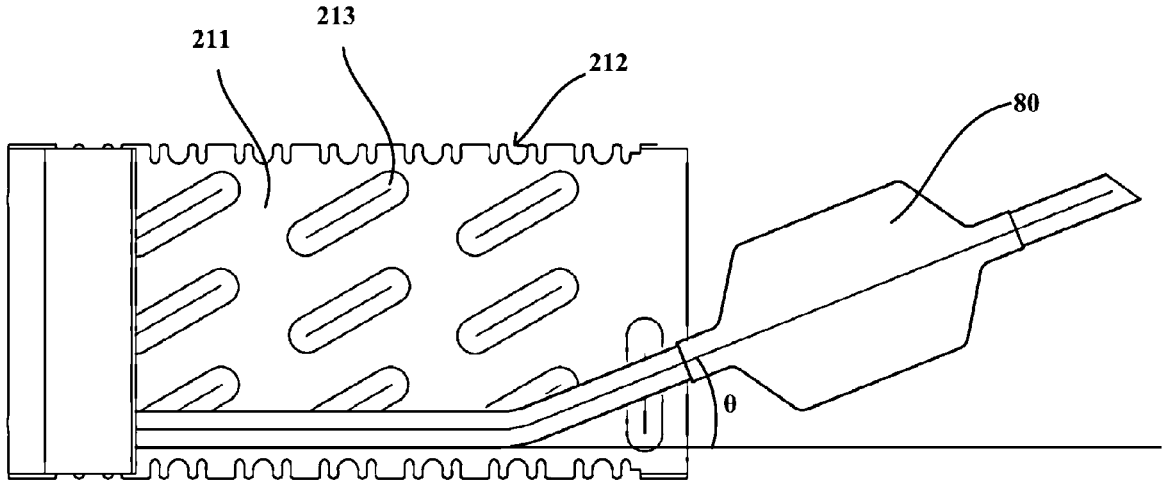
FIG. 4 is a schematic diagram of an included angle between the center line of an accumulator and a horizontal line in a refrigerator according to an embodiment of the present invention.
Figure 5:
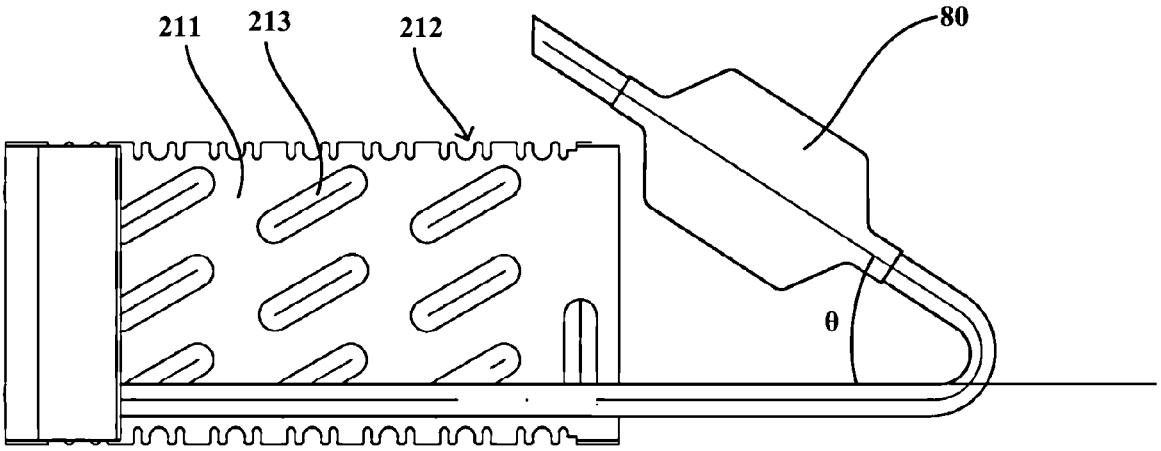
FIG. 5 is a schematic diagram of an included angle between the center line of an accumulator and a horizontal line in a refrigerator according to another embodiment of the present invention.

An embodiment provides a refrigerator, an accumulator is arranged in a cooling chamber, and a foam layer and a housing of the refrigerator may block the sound transmission of the flow of a liquid refrigerant. In particular, the foam layer has a good sound insulation effect. The accumulator is connected to an evaporator and an included angle between the center line of the accumulator and a horizontal line is 1° to 89°, which can make the internal structure of the cooling chamber compact and prevent the occupation of too much space. FIG. 1 is a schematic diagram of a front structure of a refrigerator 100 according to an embodiment of the present invention. FIG. 2 is a schematic diagram of a side structure of a refrigerator 100 according to an embodiment of the present invention. FIG. 3 is a schematic diagram of a connection structure of an evaporator 21 and an accumulator 80 of a refrigerator 100 according to an embodiment of the present invention. FIG. 4 is a schematic diagram of an included angle between the center line of an accumulator 80 and the horizontal line in a refrigerator 100 according to an embodiment of the present invention. FIG. 5 is a schematic diagram of an included angle between the center line of an accumulator 80 and the horizontal line in a refrigerator 100 according to another embodiment of the present invention. As shown in FIG. 1 to FIG. 5, the refrigerator 100 provided by the present embodiment may generally include a cabinet 10, a door body 20, an evaporator 21 and an accumulator 80.

A cooling chamber 11 and at least one storage space are defined in the cabinet 10. The cooling chamber 11 is arranged at the bottom of the cabinet 10 and directly below the storage space. As shown in FIG. 1 and FIG. 2, the refrigerator 100 provided by the present embodiment may include two storage spaces, a first space 131 and a second space 132, arranged from top to bottom. The first space 131 and the second space 132 can each be configured as a refrigeration space, a freezing space, a variable temperature space or a fresh-keeping space according to different purposes. Each storage space can be divided into a plurality of storage areas through partition plates, and articles are stored through racks or drawers.

The door body 20 is arranged on a front surface of the cabinet 10 so as to operably open and close the storage space. The door body 20 and the storage space are arranged correspondingly, that is, each storage space corresponds to one or more door bodies 20. As shown in FIG. 2, the door bodies 20 may be pivotally arranged on the front surface of the cabinet 10. In some other embodiments, the door body 20 may be opened in the mode of a drawer, and drawer sliding rails may be arranged at the bottom of the drawer to ensure that the effect is soft and noise is reduced in opening and closing processes of the drawer.

The evaporator 21 is wholly horizontally arranged in the cooling chamber 11 in the shape of a flat box and is configured to provide cooling capacity for the storage space. The evaporator 21 is wholly horizontally arranged in the cooling chamber 11 in the shape of a flat box, i.e., a length-width face of the evaporator 21 is parallel to the horizontal plane, and a thickness face thereof is perpendicular to the horizontal plane. The evaporator 21 provides different cooling capacity for the various types of storage spaces, so that the temperatures in the various types of storage spaces are different. For example, the temperature of the refrigeration space is generally between 2° C. and 10° C., preferably 4° C. to 7° C. The temperature of the freezing space is generally between −22° C. and −14° C. Optimal storage temperatures for different types of articles are different, and thus suitable storage spaces are also different. For example, fruits and vegetables are suitable for storage in the refrigeration space or fresh-keeping space, while meat is suitable for storage in the freezing space.

In a specific embodiment, the refrigerator 100 of the present embodiment is provided with a plurality of storage spaces including a refrigeration space and at least one freezing space. As shown in FIG. 1 and FIG. 2, the cabinet 10 may include a refrigeration liner 72 and a freezing liner 71. The cooling chamber 11 and at least one freezing space located above the cooling chamber 11 are defined in the freezing liner 71. the refrigeration liner 72 with a refrigeration space being defined in it is arranged just above the freezing liner 71. Specifically, in the present embodiment, the first space 131 is defined in the refrigeration liner 72 and may be provided as a refrigeration space, the second space 132 and the cooling chamber 11 are defined in the freezing liner 71, and the second space 132 may be provided as a freezing space. That is, the second space 132 of the refrigerator 100 of the present embodiment is adjacently arranged on the cooling chamber 11, while the first space 131 is arranged above the cooling chamber 11 with a spacing from it.

In addition, the cabinet 10 may further include a housing 60 and a foam layer 73. The housing 60 is arranged outside the freezing liner 71 and the refrigeration liner 72. The foam layer 73 is arranged between the housing 60 and the refrigeration liner 72 and the freezing liner 71 to insulate heat outside the refrigerator 100.

The accumulator 80 is arranged in the cooling chamber 11 and is connected to the evaporator 21. Specifically, one end of the accumulator 80 is connected to the evaporator 21, while the other end is connected to a compressor. A gas-liquid mixed refrigerant flows out of the evaporator 21 and then flows into the compressor through the accumulator 80. On one hand, the accumulator 80 can enable the refrigerant to be subjected to gas-liquid separation to prevent the compressor from generating liquid hammer. On the other hand, a certain amount of liquid refrigerant can be stored in the accumulator 80, and the amount of the refrigerant can be adjusted according to the environment temperature, so that the refrigerator 100 can obtain a good refrigerating effect at different environment temperatures. The accumulator 80 is arranged in the cooling chamber 11, the foam layer 73 and the housing 60 of the refrigerator 100 may block the sound transmission of the flow of the liquid refrigerant, and in particular, the foam layer 73 has a good sound insulation effect, so that noise is reduced, and user experience is enhanced.

As shown in FIG. 4 and FIG. 5, an included angle θ between the center line of the accumulator 80 and a horizontal line is 1° to 89°, that is, the accumulator 80 is not arranged perpendicular to the horizontal line. It should be noted that the center line of the accumulator 80 refers to the centerline in a direction in which the liquid refrigerant flows into and out of the accumulator 80. Specifically, the accumulator 80 shown in FIG. 4 is progressively away from the evaporator 21 from bottom to top, while the accumulator 80 shown in FIG. 5 is progressively close to the evaporator 21 from bottom to top. The accumulator 80 is connected to the evaporator 21 and the included angle between the center line of the accumulator 80 and the horizontal line is 1° to 89°, which avoids increasing the longitudinal height of the cooling chamber 11 due to the fact that the accumulator 80 is perpendicular to the horizontal line, and can make the internal structure of the cooling chamber 11 compact and prevent the occupation of too much space.

As shown in FIG. 1 and FIG. 2, the refrigerator 100 may further include an air supply duct 31 which is arranged on inner sides of rear walls of the refrigeration liner 72 and the freezing liner 71, an air supply inlet 312 in communication with the cooling chamber 11 is formed in a bottom end of the air supply duct 31, and air supply outlets 311 are formed in the positions corresponding to the refrigeration space and the freezing space, so as to transmit the cooling capacity provided by the evaporator 21 to the storage space. Since the air supply outlet 311 is located on the rear side of each storage space, the cooling capacity for each storage space is transmitted from the rear side to a front side.

In a preferred embodiment, as shown in FIG. 2, the refrigerator 100 may further include a refrigerating fan 22 arranged behind the evaporator 21, and the air blowing direction of the refrigerating fan 22 may directly face the air supply inlet 312, so that the cooling capacity generated by the evaporator 21 smoothly enters the air supply duct 31. An air door 313 may be arranged in the air supply duct 31, and the air door 313 is controlled to be opened and closed to adjust the cooling capacity entering the refrigeration space.

Figure 6:
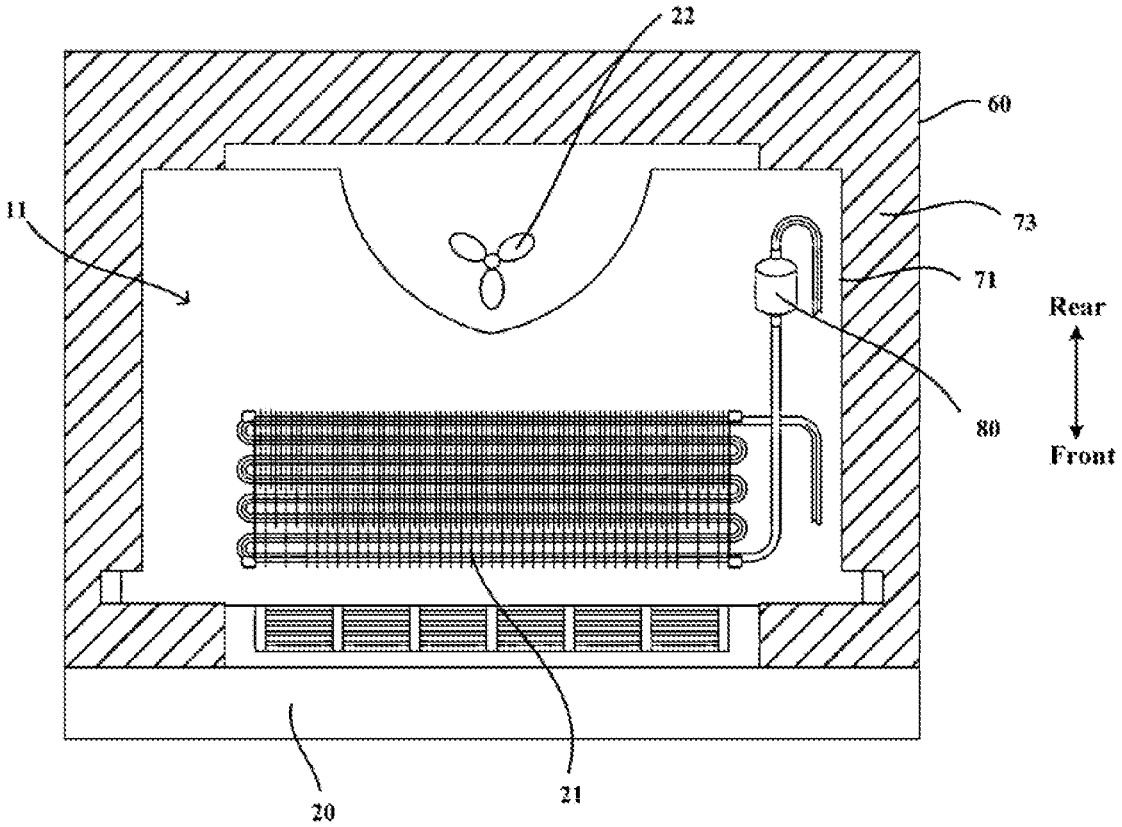
FIG. 6 is a schematic diagram of the position of an accumulator in a refrigerator according to an embodiment of the present invention.
Figure 7:
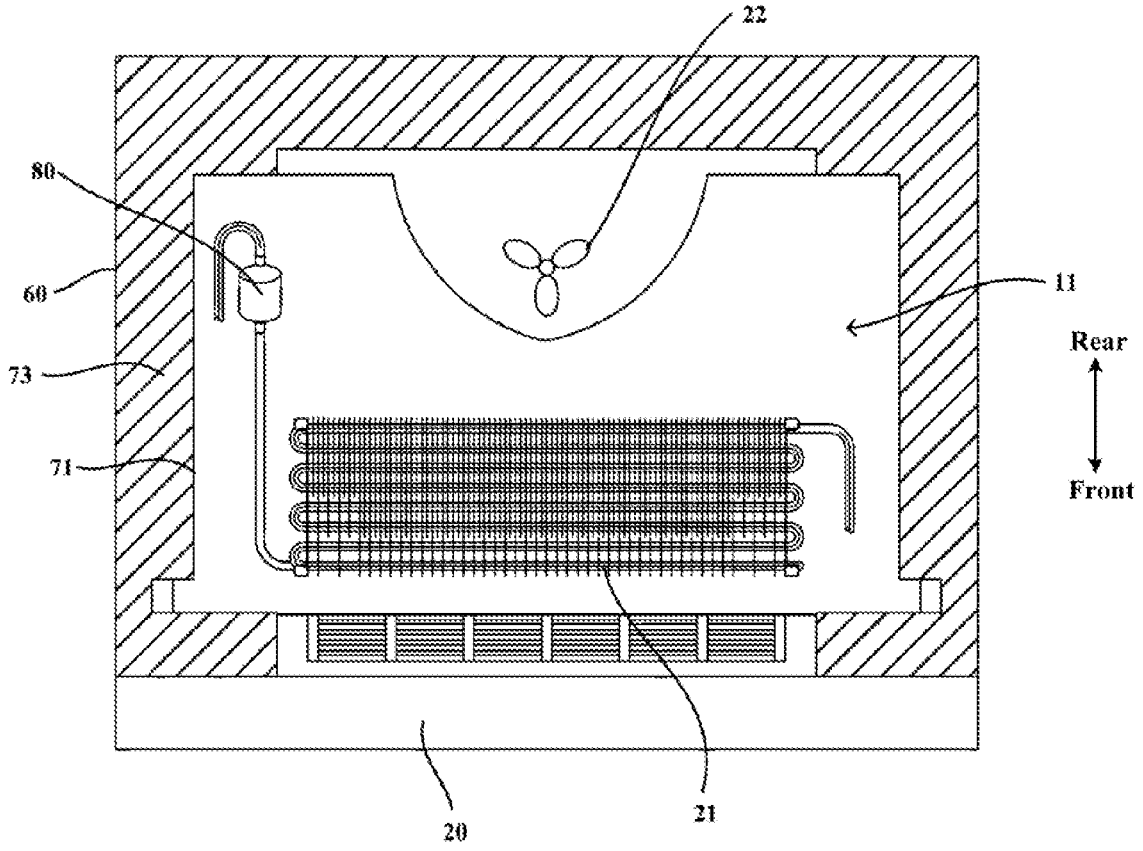
FIG. 7 is a schematic diagram of the position of an accumulator in a refrigerator according to another embodiment of the present invention.
Figure 8:
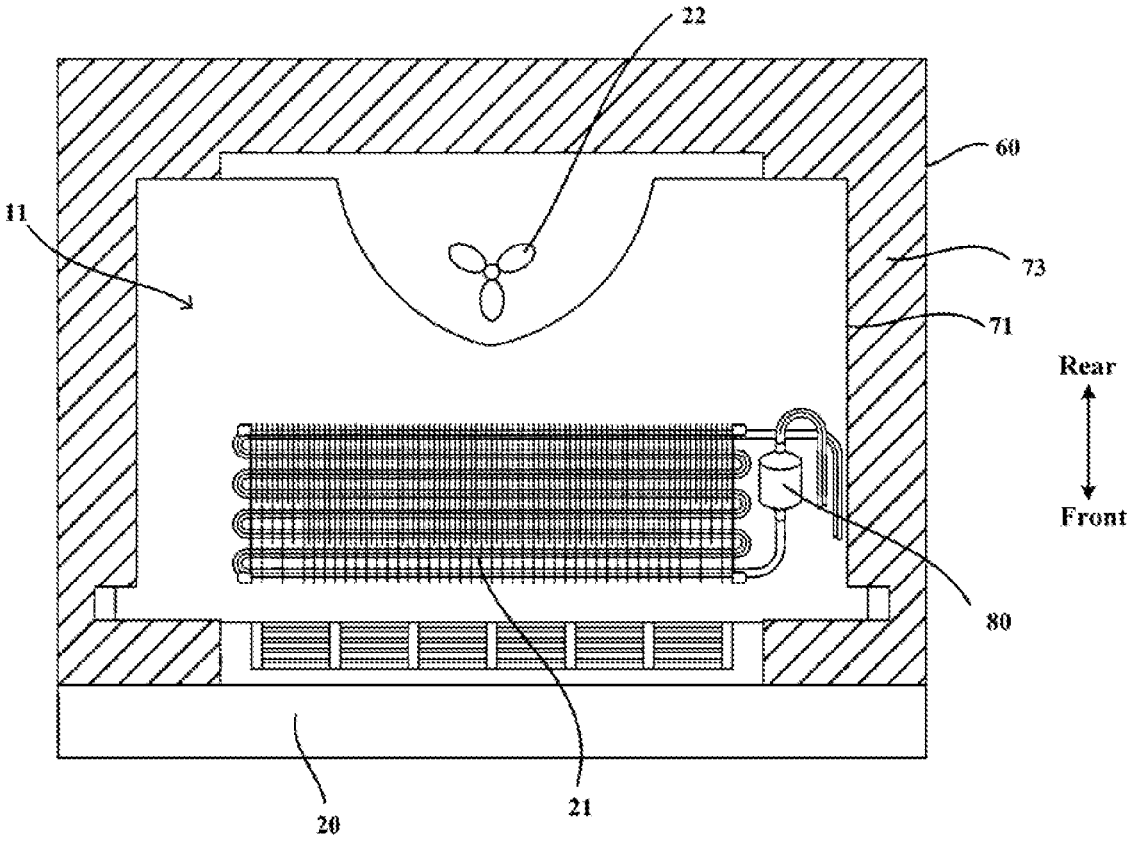
FIG. 8 is a schematic diagram of the position of an accumulator in a refrigerator according to yet another embodiment of the present invention.
Figure 9:
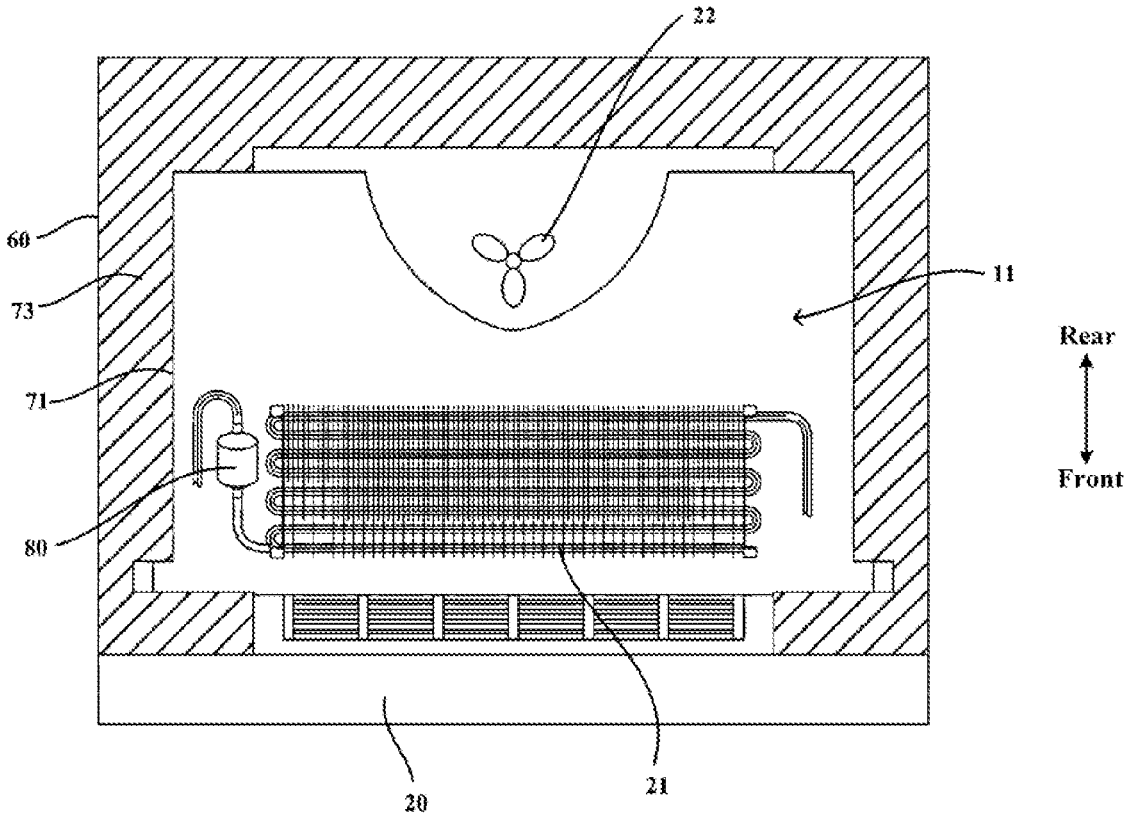
FIG. 9 is a schematic diagram of the position of an accumulator in a refrigerator according to yet another embodiment of the present invention.
Figure 10:
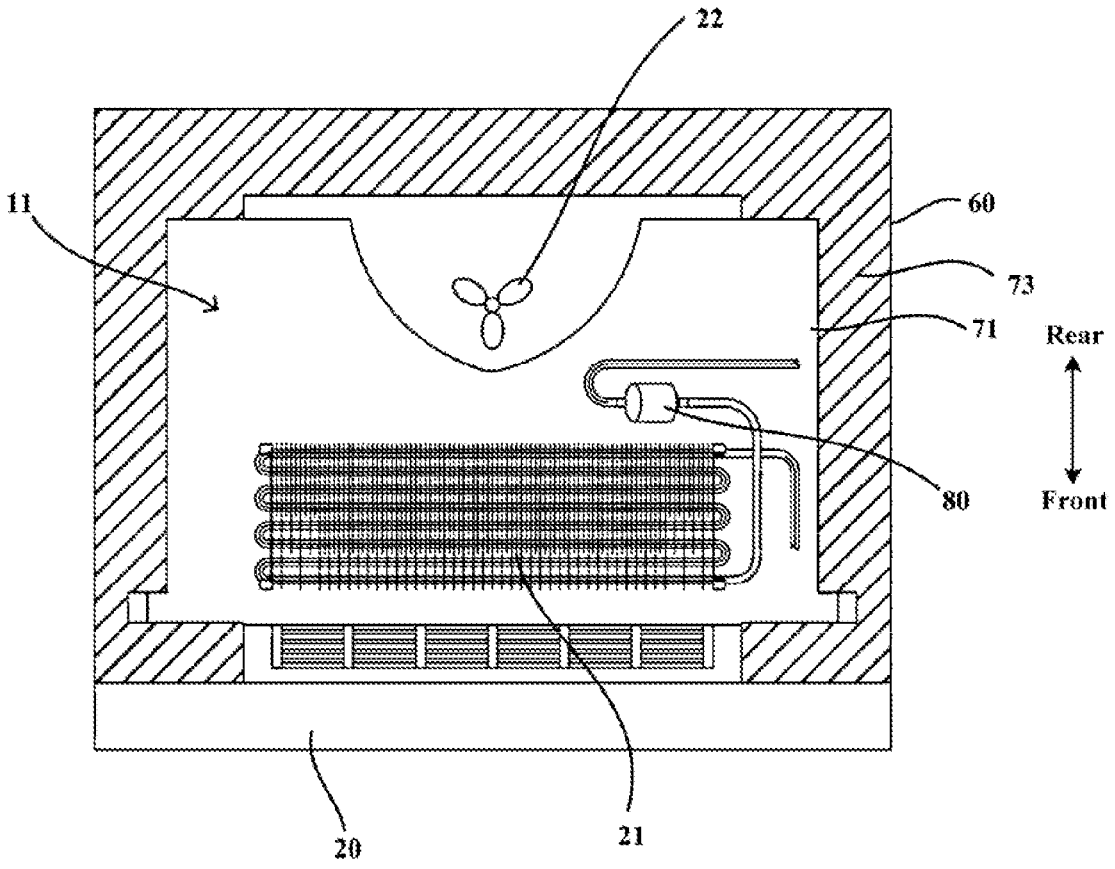
FIG. 10 is a schematic diagram of the position of an accumulator in a refrigerator according to yet another embodiment of the present invention.
Figure 11:
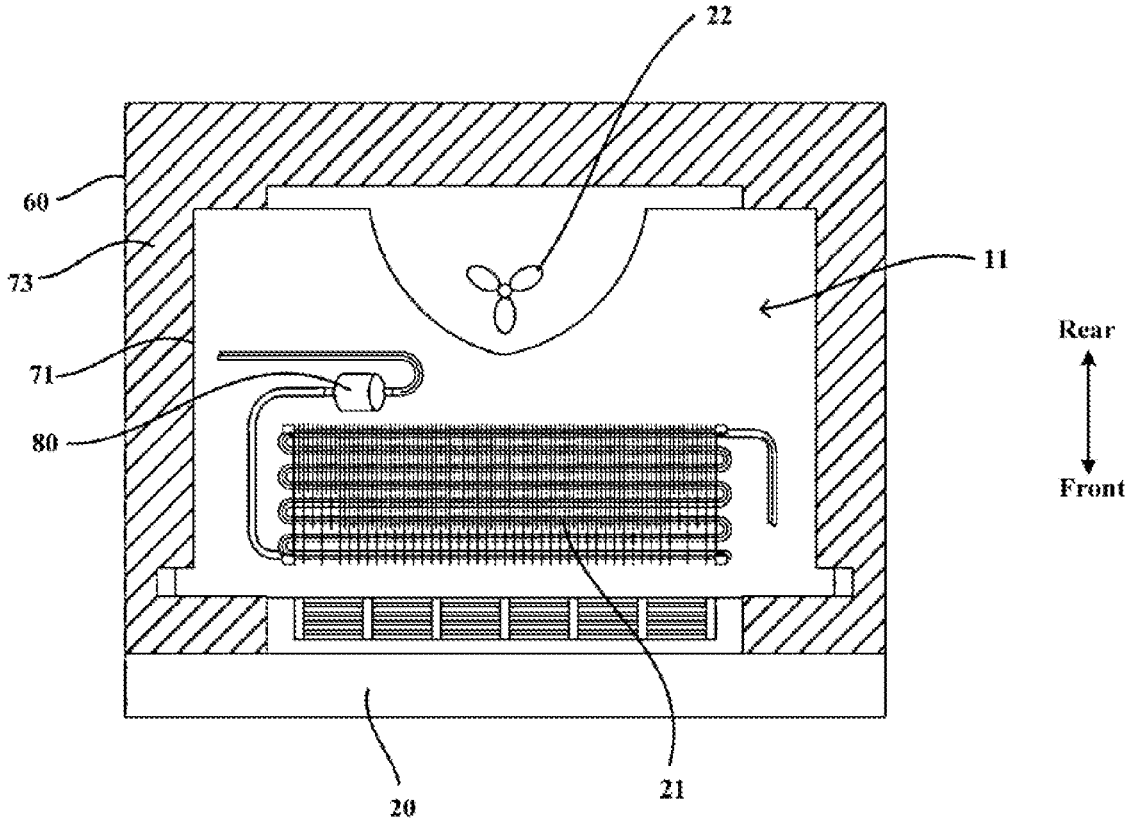
FIG. 11 is a schematic diagram of the position of an accumulator in a refrigerator according to yet another embodiment of the present invention.

FIG. 6 is a schematic diagram of the position of an accumulator 80 in a refrigerator 100 according to an embodiment of the present invention. FIG. 7 is a schematic diagram of the position of an accumulator 80 in a refrigerator 100 according to another embodiment of the present invention. FIG. 8 is a schematic diagram of the position of an accumulator 80 in a refrigerator 100 according to yet another embodiment of the present invention. FIG. 9 is a schematic diagram of the position of an accumulator 80 in a refrigerator 100 according to yet another embodiment of the present invention. FIG. 10 is a schematic diagram of the position of an accumulator 80 in a refrigerator 100 according to yet another embodiment of the present invention. FIG. 11 is a schematic diagram of the position of an accumulator 80 in a refrigerator 100 according to yet another embodiment of the present invention.

As shown in FIG. 6, the accumulator 80 may be arranged in a space enclosed by the refrigerating fan 22, the evaporator 21 and a right side of the freezing liner 71. As shown in FIG. 7, the accumulator 80 may be arranged in a space enclosed by the refrigerating fan 22, the evaporator 21 and a left side of the freezing liner 71. As shown in FIG. 8, the accumulator 80 may be arranged between the evaporator 21 and the right side of the freezing liner 71. As shown in FIG. 9, the accumulator 80 may be arranged between the evaporator 21 and the left side of the freezing liner 71. As shown in FIG. 10 and FIG. 11, the accumulator 80 may be arranged between the evaporator 21 and the refrigerating fan 22. Specifically, the accumulator 80 shown in FIG. 10 is positioned to the right between the evaporator 21 and the refrigerating fan 22. The accumulator 80 shown in FIG. 11 is positioned to the left between the evaporator 21 and the refrigerating fan 22. The accumulator 80 is arranged in the cooling chamber 11 according to the position of any embodiment above, and the spare space in the cooling chamber 11 can be fully utilized, so that the internal structure of the cooling chamber 11 is compact, and the extra space of the refrigerator 100 is not occupied. Moreover, it is guaranteed that noise generated when the liquid refrigerant flows is blocked by the foam layer 73 and the housing 60, and thus user experience is improved.

Figure 12:
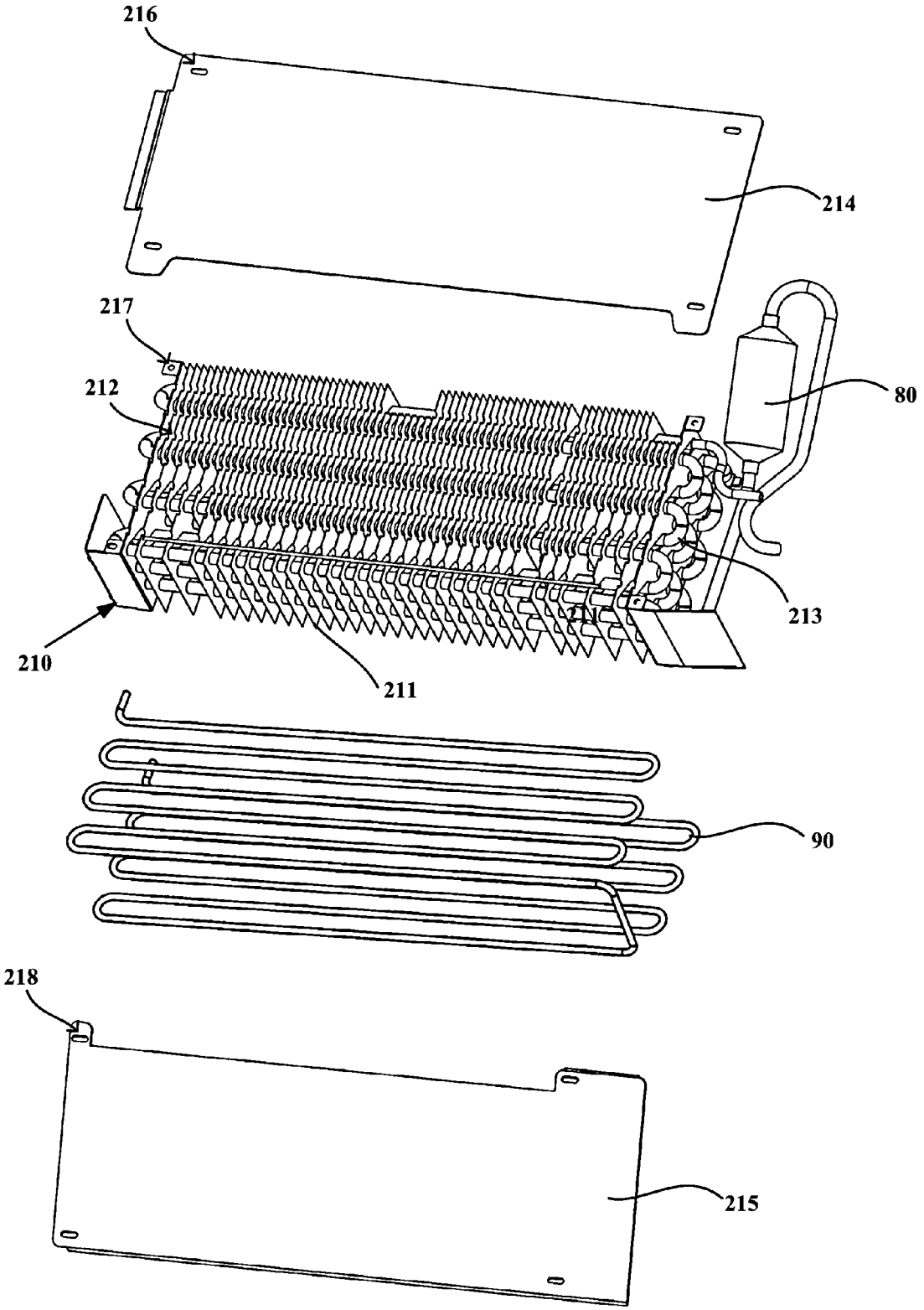
FIG. 12 is an exploded schematic diagram of a partial structure of a refrigerator according to an embodiment of the present invention.

FIG. 12 is an exploded schematic diagram of a partial structure of a refrigerator 100 according to an embodiment of the present invention. As shown in FIG. 3 and FIG. 12, the evaporator 21 may include an evaporator body 210, an upper cover plate 214 and a lower cover plate 215. The evaporator body 210 may include a plurality of fins 211 arranged in parallel and a coil 213 penetrating through the fins 211, that is, the evaporator body 210 of the present embodiment is a finned evaporator. The upper cover plate 214 is arranged at the top of the evaporator body 210. The lower cover plate 215 is arranged at the bottom of the evaporator body 210.

As shown in FIG. 4, FIG. 5 and FIG. 12, notches 212 are formed in corresponding positions of each fin 211, and passages laterally extending along the evaporator 21 are formed by the notches 212 in the corresponding positions. The refrigerator 100 may further include a heating wire 90 embedded in the passages to defrost the evaporator 21. As shown in FIG. 12, the heating wire 90 may be bent and embedded in the passages to defrost the evaporator 21. Moreover, the heating wire 90 may be an aluminum pipe heating wire, and metal aluminum can effectively enhance the heat conduction effect of the heating wire 90, so that the defrosting effect of the evaporator 21 is enhanced, the evaporator 21 is prevented from frosting to influence normal work, and the working reliability of the evaporator 21 is improved.

In a preferred embodiment, the plurality of passages are arranged at an upper end and a lower end of the fins 211, and the heating wire 90 is integrally bent and embedded in the passages at the upper end and the lower end of the fins 211. That is, one terminal of the heating wire 90 may be located at the upper end of the fins 211, the heating wire is bent along the passages at the upper end of the fins 211 and then bent along the passages at the lower end of the fins 211, and the other terminal of the heating wire 90 may be located at the lower end of the fins 211. The two terminals are connected with wiring terminals in the refrigerator 100 and are further connected to a main control panel of the refrigerator 100 through the wiring terminals so as to control the working state of the heating wire 90. The heating wire 90 is integrally arranged at the upper end and the lower end of the evaporator body 210 and directly heats the upper end and the lower end of the evaporator body 210, so that the defrosting efficiency is improved, and thus the working reliability of the evaporator 21 is further improved.

As shown in FIG. 12, first fixing holes 216 are formed in four corners of the upper cover plate 214, and second fixing holes 217 are correspondingly formed in four corners of the top of the evaporator body 210 in position. Third fixing holes 218 are formed in four corners of the lower cover plate 215, and fourth fixing holes (not shown in the figure) are correspondingly formed in four corners of the bottom of the evaporator body 210 in position. The evaporator 21 may further include fixing members (not shown in the figure) configured to pass through the aligned first fixing holes 216 and second fixing holes 217 to fix the upper cover plate 214 and the evaporator body 210, and pass through the aligned third fixing holes 218 and fourth fixing holes to fix the lower cover plate 215 and the evaporator body 210. Specifically, the fixing members may be screws, rivets, cable ties, or the like.

In a preferred embodiment, the first fixing holes 216 and the third fixing holes 218 are kidney-shaped holes, and the second fixing holes 217 and the fourth fixing holes are circular holes. Due to the specific shape setting of the fixing holes, it can be guaranteed that there is no gap between the upper cover plate 214 and the evaporator body 210 and between the lower cover plate 215 and the evaporator body after they are fixed, the situation that the refrigerating fan 22 is frosted up due to the fact that return air of the freezing space directly blows to the refrigerating fan 22 without heat exchange through the evaporator 21 is avoided, the working reliability of the refrigerating fan 22 is effectively guaranteed, and thus the overall refrigerating capacity of the refrigerator 100 is improved. In addition, the upper cover plate 214 and the lower cover plate 215 are arranged at the top and the bottom of the evaporator body 210 respectively, the overall structure of the evaporator 21 is simplified, and the production cost is effectively reduced. It should also be noted that both the upper cover plate 214 and the lower cover plate 215 are fixed to the evaporator body 210 in which the heating wire 90 is embedded. Therefore, the upper cover plate 214 and the lower cover plate 215 can prevent the heating wire 90 from tilting, and ensure that the heating wire 90 is flatly embedded in the passages of the fins 211.

As shown in FIG. 1 and FIG. 2, a water pan 40 may be formed on a bottom wall, serving as a bottom wall of the cooling chamber 11, of the freezing liner 71 to receive condensed water generated by the evaporator 21. In a preferred embodiment, as shown in FIG. 2, a front section bottom wall and a rear section bottom wall of the cooling chamber 11 are both sloped downwards in respective directions. A certain included angle is formed between each of the front section bottom wall and the rear section bottom wall of the cooling chamber 11 and the horizontal plane, so that the condensed water generated by the evaporator 21 can smoothly enter the water pan 40 and can be completely discharged, and the working reliability of the evaporator 21 is effectively guaranteed.

A water outlet 41 is formed in the joint of the front section bottom wall and the rear section bottom wall of the cooling chamber 11, and is located below the evaporator 21. The inclination of the front section bottom wall is greater than that of the rear section bottom wall, so that the water outlet 41 is close to the front end of the evaporator 21 in the horizontal direction. Therefore, after entering the cooling chamber 11 through the water outlet 41, external air first passes through the evaporator 21, and the bad phenomena of frosting, icing and the like do not directly occur on the refrigerating fan 22.

As shown in FIG. 2, a compressor chamber 12 is also defined in the cabinet 10, and the compressor chamber 12 is arranged at the bottom of the cabinet 10 and behind the cooling chamber 11. The compressor chamber 12 may be provided with a condenser, a cooling fan and a compressor therein, which are not shown in the figure because they are arranged in the compressor chamber 12. In a specific embodiment, the refrigerator 100 may further include an evaporating dish 50 arranged below the condenser to evaporate water in the evaporating dish 50 by using heat of the condenser and take away the water by the cooling fan to dissipate heat.

As shown in FIG. 2, the refrigerator 100 of the present embodiment may further include a drain pipe 42, one end of which is connected to the water outlet 41 of the water pan 40, while the other end is in communication with the evaporating dish 50, to transmit the condensed water in the water pan 40 to the evaporating dish 50. Specifically, the drain pipe 42 is obliquely placed. One end, connected to the water outlet 41, of the drain pipe 42 is higher than the other end of the drain pipe 42, and an included angle between the drain pipe 42 and the horizontal plane is larger than or equal to a preset angle. The inclined angle of the drain pipe 42 is matched with that of the water pan 40, so that the condensed water in the water pan 40 can be smoothly discharged.

As shown in FIG. 1 and FIG. 2, the refrigerator 100 may further include a return air duct 32 which is arranged on any side wall of the refrigeration liner 72 and the freezing liner 71. A return air inlet 321 in communication with the refrigeration space is formed in an upper end of the return air duct, and a return air outlet 323 in communication with the cooling chamber 11 is formed in a lower end of the return air duct, so as to return air to the cooling chamber 11 from the refrigeration space. Specifically, the return air inlet 321 is formed in the front part of the side wall of the refrigeration liner 72, the return air outlet 323 is formed in the front part of the side wall of the same side of the freezing liner 71, and the return air outlet 323 is formed in the side wall of the freezing liner 71 at the cooling chamber 11. The return air inlet 321 and the return air outlet 323 are formed in the front parts of the side walls of the refrigeration liner 72 and the freezing liner 71, so that after the cooling capacity in the refrigeration space fully cools the refrigeration space from back to front, the cooling capacity returns to the cooling chamber 11 through the return air duct 32. In a preferred embodiment, there may be two return air ducts 32 symmetrically arranged on two side walls of the refrigeration liner 72 and the freezing liner 71.

The refrigerator 100 may further include an evaporator cover plate 111 which is arranged above the evaporator 21 in a covering mode, and serves as a top wall to define the cooling chamber 11 together with the freezing liner 71. In a preferred embodiment, a freezing return air inlet 112 in communication with the freezing space is formed in a front end of the evaporator cover plate 111 to return air to the cooling chamber 11 from the freezing space. Specifically, the freezing return air inlet 112 may be louver-shaped. The second space 132 of the present embodiment serves as the freezing space and is adjacently arranged on the cooling chamber 11, so that air can be quickly returned to the cooling chamber 11 through the freezing return air inlet 112.

The refrigerator 100 provided by the present embodiment includes the cabinet, in which the cooling chamber 11 and the at least one storage space are defined, the cooling chamber 11 being arranged at the bottom of the cabinet and directly below the storage space; the door body 20, which is arranged on the front surface of the cabinet so as to operably open and close the storage space; the evaporator 21, which is wholly horizontally placed in the cooling chamber 11 in the shape of a flat box, and is configured to provide the cooling capacity to the storage space; and the accumulator 80, which is arranged in the cooling chamber 11 and connected to the evaporator 21. The included angle between the center line of the accumulator 80 and the horizontal line is 1° to 89°. The accumulator 80 is arranged in the cooling chamber 11, and the foam layer 73 and the housing 60 of the refrigerator 100 may block the sound transmission of the flow of the liquid refrigerant, and in particular, the foam layer 73 has the good sound insulation effect. The accumulator 80 is connected to the evaporator 21 and the included angle between the center line of the accumulator 80 and the horizontal line is 1° to 89°, which can make the internal structure of the cooling chamber 11 compact and prevent the occupation of too much space.

Further, in the refrigerator 100 provided by the present embodiment, the evaporator 21 includes the evaporator body 210, the upper cover plate 214 and the lower cover plate 215. The evaporator body 210 includes the plurality of fins 211 arranged in parallel and the coil 213 penetrating through the fins 211, the upper cover plate 214 is arranged at the top of the evaporator body 210, and the lower cover plate 215 is arranged at the bottom of the evaporator body 210. The first fixing holes 216 are formed in four corners of the upper cover plate 214, and the second fixing holes 217 are correspondingly formed in four corners of the top of the evaporator body 210 in position. The third fixing holes 218 are formed in four corners of the lower cover plate 215, and the fourth fixing holes are correspondingly formed in four corners of the bottom of the evaporator body 210 in position. The evaporator 21 further includes fixing members configured to pass through the aligned first fixing holes 216 and second fixing holes 217 to fix the upper cover plate 214 and the evaporator body 210, and pass through the aligned third fixing holes 218 and fourth fixing holes to fix the lower cover plate 215 and the evaporator body 210. The first fixing holes 216 and the third fixing holes 218 are kidney-shaped holes, and the second fixing holes 217 and the fourth fixing holes are circular holes, so that it is guaranteed that there is no gap after the upper cover plate 214 and the evaporator body 210 and between the lower cover plate 215 and the evaporator body 210 after they are fixed, the situation that the refrigerating fan 22 is frosted up due to the fact that the return air of the freezing space directly blows to the refrigerating fan 22 without heat exchange through the evaporator 21 is avoided, the working reliability of the refrigerating fan 22 is effectively guaranteed, and thus the overall refrigerating capacity of the refrigerator 100 is improved. In addition, the upper cover plate 214 and the lower cover plate 215 are arranged at the top and the bottom of the evaporator body 210 respectively, the overall structure of the evaporator 21 is simplified, and the production cost is effectively reduced.

Hereto, those skilled in the art should realize that although multiple exemplary embodiments of the present invention have been shown and described in detail herein, without departing from the spirit and scope of the present invention, many other variations or modifications that conform to the principles of the present invention can still be directly determined or deduced from the contents disclosed in the present invention. Therefore, the scope of the present invention should be understood and recognized as covering all these other variations or modifications.

What is claimed is:

1. A refrigerator, comprising a cabinet defining a cooling chamber and at least one storage space therein, the cooling chamber being arranged at a bottom of the cabinet and directly below the storage space;

a door body arranged on a front surface of the cabinet so as to operably open and close the storage space;

an evaporator wholly horizontally arranged in the cooling chamber in the shape of a flat box and configured to provide cooling capacity for the storage space; and an accumulator arranged in the cooling chamber and connected to the evaporator, an included angle between a center line of the accumulator and a horizontal line being 1° to 89°;

wherein there are a plurality of storage spaces including a refrigeration space and at least one freezing space, and the cabinet comprises a freezing liner, the cooling chamber and the at least one freezing space located above the cooling chamber being defined in the freezing liner;

wherein the refrigerator further comprises a refrigerating fan arranged behind the evaporator, wherein the accumulator is arranged in a space enclosed by the refrigerating fan, the evaporator and a right side of the freezing liner; or the accumulator is arranged in a space enclosed by the refrigerating fan, the evaporator and a left side of the freezing liner; or the accumulator is arranged between the evaporator and the right side of the freezing liner; or the accumulator is arranged between the evaporator and the left side of the freezing liner; or the accumulator is arranged between the evaporator and the refrigerating fan.

2. The refrigerator according to claim 1, wherein the cabinet further comprises a refrigeration liner arranged just above the freezing liner, the refrigeration space being defined in the refrigeration liner.

3. The refrigerator according to claim 2, further comprising an air supply duct arranged on inner sides of rear walls of the refrigeration liner and the freezing liner, an air supply inlet in communication with the cooling chamber being formed in a bottom end of the air supply duct, and air supply outlets being formed in the positions corresponding to the refrigeration space and the freezing space, so as to transmit the cooling capacity provided by the evaporator to the storage spaces.

4. The refrigerator according to claim 3, wherein an air blowing direction of the refrigerating fan directly faces the air supply inlet, so that the cooling capacity generated by the evaporator can enter the air supply duct.

5. The refrigerator according to claim 1, wherein the evaporator comprises an evaporator body, an upper cover plate and a lower cover plate, wherein the evaporator body comprises a plurality of fins arranged in parallel and coil penetrating through the fins, the upper cover plate is arranged at a top of the evaporator body, and the lower cover plate is arranged at the bottom of the evaporator body.

6. The refrigerator according to claim 5, wherein notches are formed in corresponding positions of each fin, and passages laterally extending along the evaporator are formed by the notches in the corresponding positions; and the refrigerator further comprises a heating wire embedded in the passages to defrost the evaporator.

7. The refrigerator according to claim 5, wherein first fixing holes are formed in four corners of the upper cover plate, and second fixing holes are correspondingly formed in four corners of the top of the evaporator body in position; and third fixing holes are formed in four corners of the lower cover plate, and fourth fixing holes are correspondingly formed in four corners of the bottom of the evaporator body in position.

8. The refrigerator according to claim 7, wherein the evaporator further comprises fixing members configured to pass through the aligned first fixing holes and second fixing holes to fix the upper cover plate and the evaporator body, and pass through the aligned third fixing holes and fourth fixing holes to fix the lower cover plate and the evaporator body.

9. The refrigerator according to claim 8, wherein the first fixing holes and the third fixing holes are kidney-shaped holes, and the second fixing holes and the fourth fixing holes are circular holes.

* * * * *